US008875961B1

(12) United States Patent
Watson

(10) Patent No.: US 8,875,961 B1
(45) Date of Patent: Nov. 4, 2014

(54) WETSUIT HANGER

(71) Applicant: Roy Watson, Irvine, CA (US)

(72) Inventor: Roy Watson, Irvine, CA (US)

( * ) Notice: Subject to any disclaimer, the term of this patent is extended or adjusted under 35 U.S.C. 154(b) by 42 days.

(21) Appl. No.: 13/893,446

(22) Filed: May 14, 2013

(51) Int. Cl.
*A47G 25/16* (2006.01)
*A47G 25/48* (2006.01)
*A47G 25/14* (2006.01)

(52) U.S. Cl.
CPC ..... *A47G 25/48* (2013.01)
USPC ..... 223/85

(58) Field of Classification Search
CPC ... A47G 25/14; A47G 25/16; A47G 25/4061; A41D 27/22; A47F 7/19
USPC ..... 223/85–89; D6/315, 319, 320, 325, D6/327; 211/113, 85.29, 85.3
See application file for complete search history.

(56) References Cited

U.S. PATENT DOCUMENTS

| | | | | | |
|---|---|---|---|---|---|
| 2,576,111 | A * | 11/1951 | Glenny et al. | 224/434 |
| 2,634,032 | A * | 4/1953 | Bartlett | 223/88 |
| 2,959,297 | A * | 11/1960 | Larson | 108/29 |
| 4,973,021 | A * | 11/1990 | Schuite | 248/495 |
| 5,553,823 | A * | 9/1996 | Protz, Jr. | 248/304 |
| 6,073,819 | A * | 6/2000 | Wing | 223/89 |
| 2005/0274751 | A1* | 12/2005 | Plumley et al. | 223/85 |
| 2008/0185353 | A1* | 8/2008 | Immerman et al. | 211/16 |
| 2008/0251548 | A1* | 10/2008 | Mulderig | 223/85 |
| 2011/0239814 | A1* | 10/2011 | Athanasiou | 74/551.2 |
| 2013/0240576 | A1* | 9/2013 | King | 223/85 |
| 2013/0256354 | A1* | 10/2013 | Clark et al. | 223/85 |

* cited by examiner

*Primary Examiner* — Ismael Izaguirre
(74) *Attorney, Agent, or Firm* — Vladi Khiterer

(57) ABSTRACT

A wetsuit hanger hangs over a door, fence, gate, tailgate of a truck, or similar object and comprises a member, over which the wetsuit is draped, projected away from the object the wetsuit is being hung from.

3 Claims, 4 Drawing Sheets

WETSUIT HANGER

REFERENCE TO PRIOR PROVISIONAL APPLICATION (35 U.S.C. 119(e))

This application claims the benefit of the U.S. Provisional Application No. 61/746,465 filed on Dec. 27, 2012.

FIELD OF THE INVENTION

This invention relates to a garment drying hanger and more particularly to a hanger for drying wetsuits.

BACKGROUND OF THE INVENTION

Wetsuits hung to dry from a conventional hanger of the prior art wear out prematurely in the shoulder area because they are hung to dry while heavy and wet. Further, water must travel the full length of the wetsuit in order to exit, resulting in lengthy drying time. Finally, moisture from the wetsuit can damage the door or object it is being hung against, and dirt or debris from the object it is being hung against can transfer to the wetsuit. What is needed, therefore, is a wetsuit hanger that overcomes the disadvantages discussed above.

SUMMARY OF THE INVENTION

A wetsuit hanger according to this invention overcomes the disadvantages of the prior art by allowing for wetsuits to be easily hung, about their waist-line, from a door, tailgate of a truck, or similar object, while maintaining distance between the wetsuit and the object it is being hung from. The basis for operation is the ability to project a member, over which the wetsuit is draped, away from the object the wetsuit is being hung from.

DESCRIPTION OF THE PREFERRED EMBODIMENTS

The preferred embodiments of this invention will be better understood in reference to FIG. 1 through FIG. 4. The same numerals refer to the same elements in all drawing figures.

Figure 1:
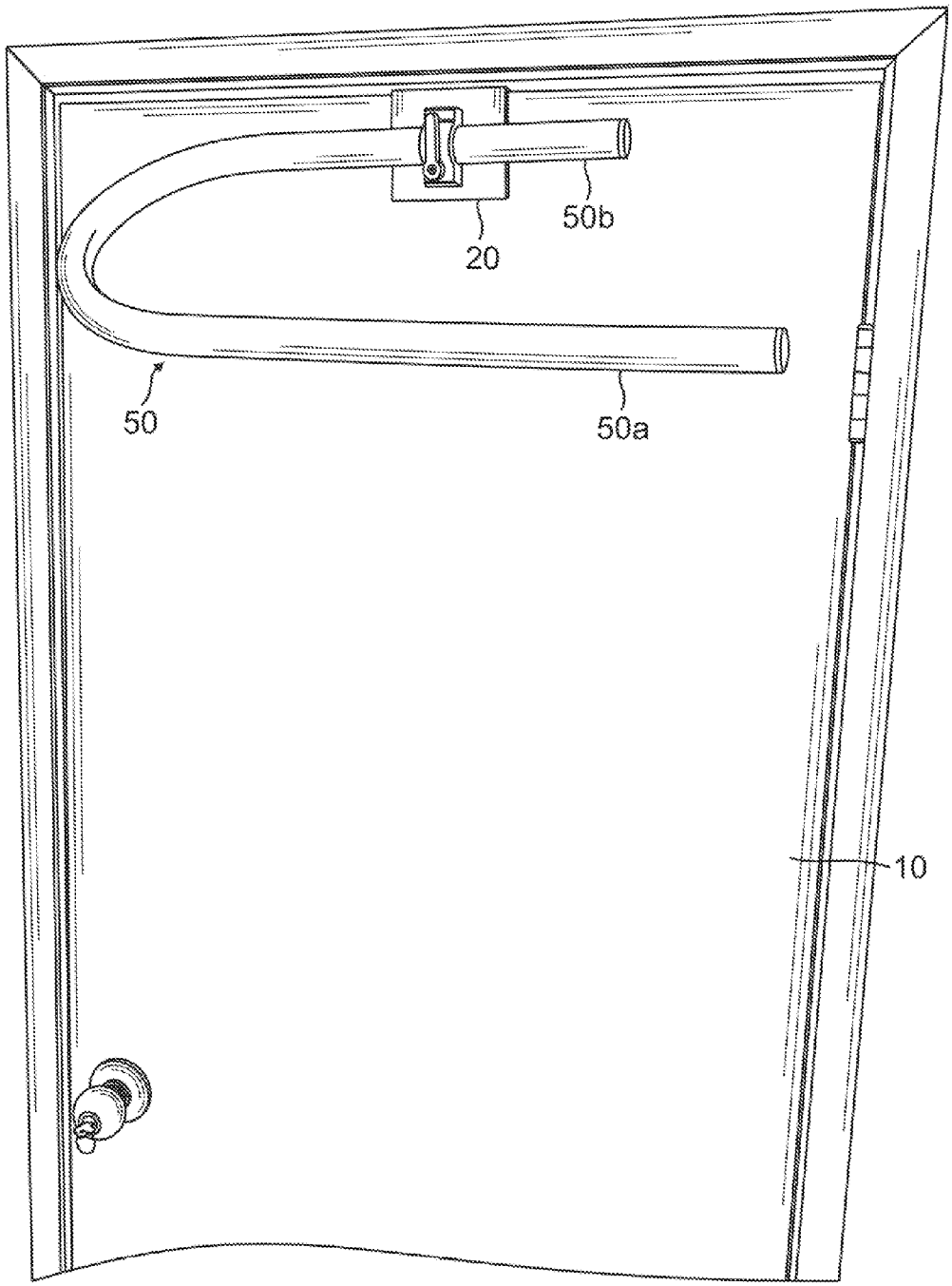
FIG. 1 and FIG. 2 show an isometric view of a wetsuit hanger according to the first embodiment of this invention.
Figure 2:
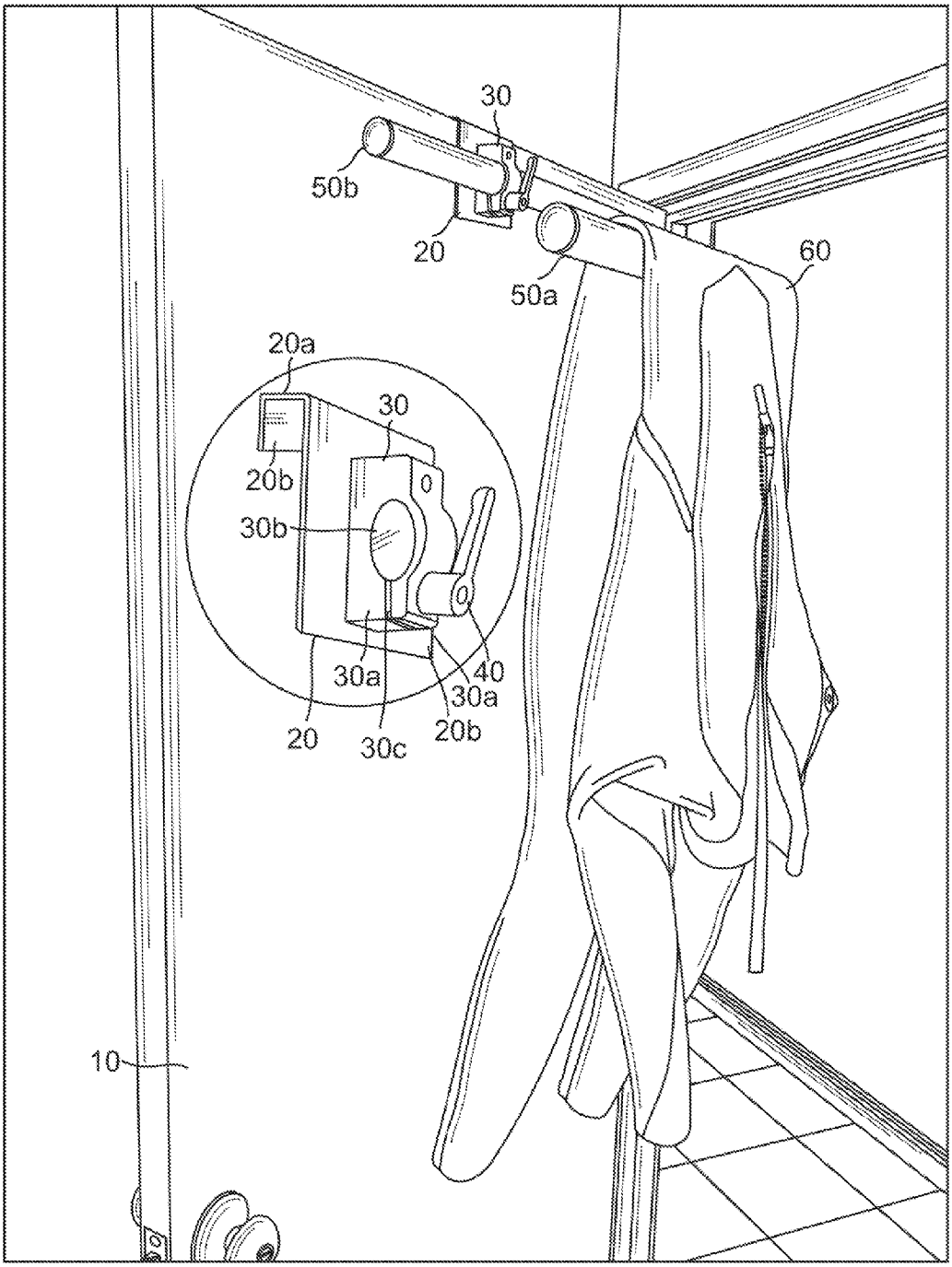

Viewing now, simultaneously, FIG. 1 and FIG. 2, numeral 10 indicates a door. It should be noted that while FIG. 1 through FIG. 4 show the wetsuit hanger of this invention hung from door 10, it can also be hung from a cabinet door, fence, gate, tailgate of a truck or similar object.

Numeral 20 indicates a substantially C-shaped bracket. C-shaped bracket 20 is disposed over a top edge of door 10. C-shaped bracket 20 comprises a substantially straight top plate indicated by numeral 20*a*. Top plate 20*a* is disposed horizontally and rests on the top edge of door 10. Top plate 20*a* can be made 1½" wide to accommodate a standard door width, or various widths to accommodate various objects, such as fences, gates or tailgates.

Numeral 20*b* indicates a pair of substantially straight flanges. Flanges 20*b* extend down vertically from top plate 20*a*.

Numeral 30 indicates an adjustable clamp. Clamp 30 is disposed on flange 20*b* on the side of door 10 from which the wetsuit is hung. Clamp 30 comprises a pair of clamping members indicated by numeral 30*a*. Clamping members 30*a* define a cylindrical bore indicated by numeral 30*b* and a slot indicated by numeral 30*c*. Slot 30*c* extends along the length of cylindrical bore 30*b*. The longitudinal axis of cylindrical bore 30*b* is disposed substantially horizontally and parallel to flanges 20*b*.

There is provided a threaded bore (not shown) that connects clamping members 30*a* through slot 30*c*. Numeral 40 indicates a screw. Screw 40 is threadably inserted inside the threaded bore, such that tightening screw 40 urges clamping members 30*a* toward one another, thereby reducing the diameter of cylindrical bore 30*b*.

Numeral 50 indicates a J-shaped tubular member. J-shaped tubular member 50 comprises a long arm indicated by numeral 50*a* and a short arm indicated by numeral 50*b*. J-shaped tubular member 50 is preferably made from an aluminum tube approximately 1.2" in diameter, however, other materials and sizes of tubing may be used.

Cylindrical bore 30*b* receives and rotationally locks short arm 50*b* by way of tightening screw 40. Long arm 50*a* receives the wetsuit indicated by numeral 60, such that wetsuit 60 is draped over long arm 50*a*, while being projected away from door 10.

Figure 3:
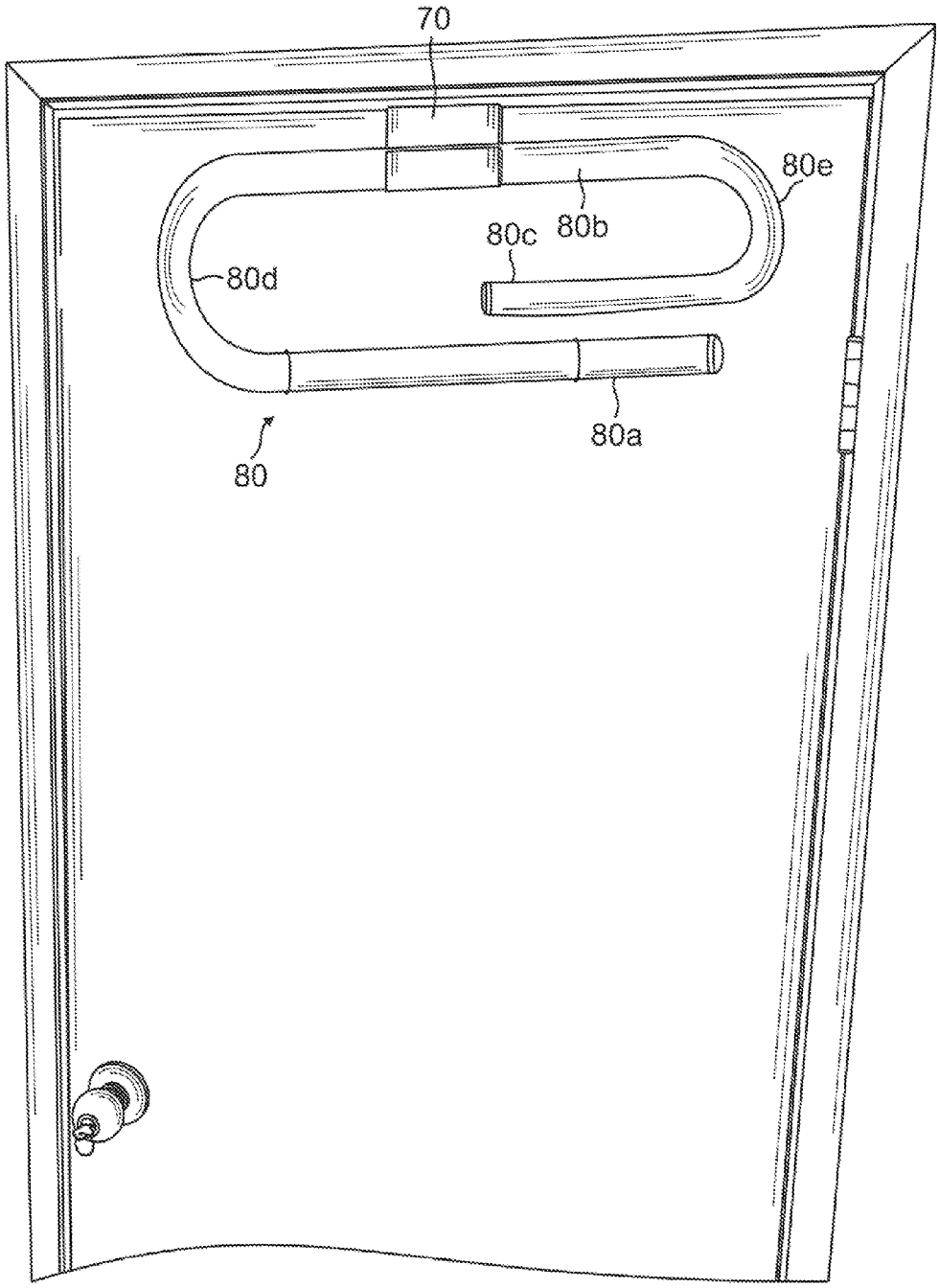
FIG. 3 and FIG. 4 show an isometric view of a wetsuit hanger according to the second embodiment of this invention.
Figure 4:
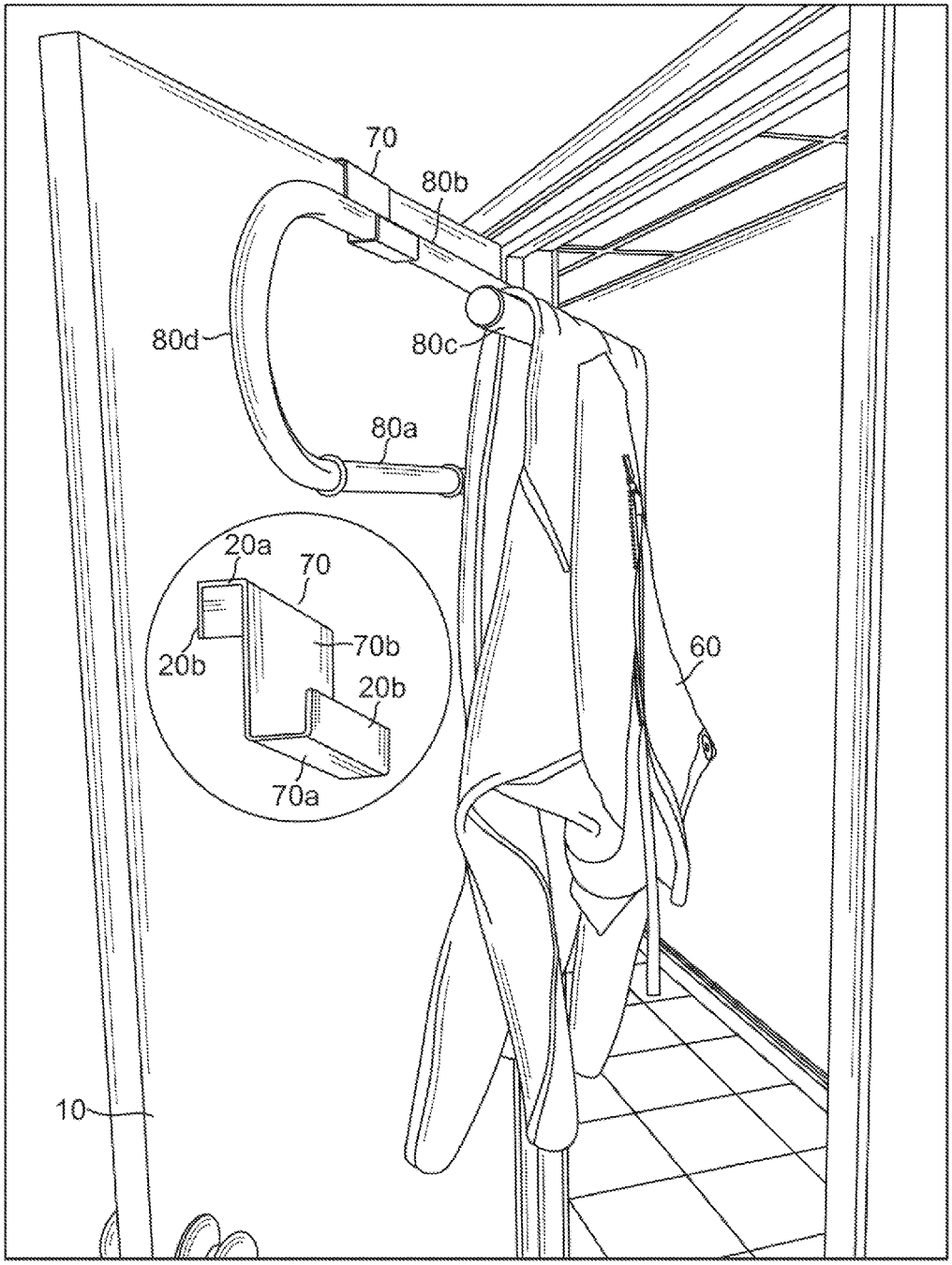

Viewing now, simultaneously, FIG. 3 and FIG. 4, numeral 70 indicates a substantially S-shaped bracket. S-shaped bracket 70 is disposed over the top edge of door 10. S-shaped bracket 70 comprises top plate 20*a*. Top plate 20*a* is disposed horizontally and rests on the top edge of door 10.

Numeral 70*a* indicates a substantially straight bottom plate. Bottom plate 70*a* is disposed horizontally. Numeral 70*b* indicates a substantially straight connecting flange. Connecting flange 70*b* is disposed vertically and connects top plate 20*a* and bottom plate 70*a*.

One flange 20*b* extends down vertically from top plate 20*a* and another flange 20*b* extends up vertically from bottom plate 70*a*.

Numeral 80 indicates a tubular member. Tubular member 80 comprises a first arm indicated by numeral 80*a*, a second arm indicated by numeral 80*b*, a third arm indicated by numeral 80*c*, a first U-shaped member indicated by numeral 80*d* and a second U-shaped member indicated by numeral 80*e*.

First U-shaped member 80*d* connects first arm 80*a* and second arm 80*b*. First arm 80*a*, first U-shaped member 80*d* and second arm 80*b* define a first plane.

Second U-shaped member 80*e* connects second arm 80*b* and third arm 80*c*. Second arm 80*b*, second U-shaped member 80*e* and third arm 80*c* define a second plane.

The second plane is disposed at an angle ranging from about ten degrees to about eighty degrees with respect to the first plane. The angle between the first plane and the second plane shown in FIG. 3 and FIG. 4 is substantially sixty degrees.

The first plane is resting on the side of door 10 from which wetsuit 60 is hung. Second arm 80*b* rests on bottom plate 70*a*. Third arm 80*c* receives wetsuit 60, such that wetsuit 60 is draped over third arm 80*c*, while being projected away from door 10.

While the present invention has been described and defined by reference to the preferred embodiments of the invention, such reference does not imply a limitation on the invention, and no such limitation is to be inferred. The invention is capable of considerable modification, alteration, and equivalents in form and function, as will occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A wetsuit hanger comprising:

a substantially C-shaped bracket disposed over a top edge of a door, the bracket comprising a substantially straight top plate disposed horizontally and a pair of substantially straight flanges extending down vertically from the top plate, such that the top plate is resting on the top edge of the door;

an adjustable clamp disposed on one of the flanges, the clamp comprising a pair of clamping members defining a cylindrical bore and a slot extending along the length of the cylindrical bore, such that the longitudinal axis of the cylindrical bore is disposed substantially horizontally and parallel to the flanges;

a threaded bore connecting the clamping members through the slot and a screw threadably inserted inside the threaded bore, such that tightening the screw urges the clamping members toward one another, thereby reducing the diameter of the cylindrical bore;

a J-shaped tubular member comprising a long arm and a short arm, wherein the cylindrical bore receiving and rotationally locking the short arm by way of tightening the screw;

wherein the long arm receiving the wetsuit, such that the wetsuit is draped over the long arm, while being projected away from the door.

2. A wetsuit hanger comprising:

a substantially S-shaped bracket disposed over a top edge of a door, the bracket comprising a substantially straight top plate disposed horizontally and resting on the top edge of the door, a substantially straight bottom plate disposed horizontally, a substantially straight vertically disposed connecting flange connecting the top and bottom plates, a substantially straight flange extending down vertically from the top plate and a substantially straight flange extending up vertically from the bottom plate;

a tubular member comprising a first arm, a second arm, a third arm, a first U-shaped member and a second U-shaped member;

wherein the first U-shaped member connecting the first arm and the second arm, such that the first arm, the first U-shaped member and the second arm defining a first plane;

wherein the second U-shaped member connecting the second arm and the third arm, such that the second arm, the second U-shaped member and the third arm defining a second plane;

wherein the second plane is disposed at an angle ranging from about: ten degrees to about eighty degrees with respect to the first plane;

wherein the first plane resting on a side of the door and the first arm resting on the bottom plate;

wherein the third arm receiving the wetsuit, such that the wet suit is draped over the third arm, while being projected away from the door.

3. A wetsuit hanger as in claim 2, wherein the angle is substantially sixty degrees.

* * * * *